US005569529A

United States Patent [19]

Becker et al.

[11] Patent Number: 5,569,529

[45] Date of Patent: Oct. 29, 1996

[54] INK JET PRINTING MATERIAL

[75] Inventors: Dieter Becker, Georgsmarienhutte; Gerhard Dransmann; Jurgen Graumann, both of Osnabruck, all of Germany

[73] Assignee: Felix Schoeller Jr. Foto-und Spezial-papiere GmbH & Co. KG, Osnabruck, Germany

[21] Appl. No.: 497,637

[22] Filed: Jun. 30, 1995

Related U.S. Application Data

[63] Continuation of Ser. No. 261,155, Jun. 17, 1994, abandoned.

[30] Foreign Application Priority Data

Jul. 3, 1993 [DE] Germany ..... 43 22 179.3

[51] Int. Cl.[6] ..... B41M 5/00

[52] U.S. Cl. ..... 428/331; 428/195; 428/211; 428/341; 428/342; 428/520

[58] Field of Search ..... 428/195, 207, 428/500, 520, 411, 331, 328, 211, 341, 342

[56] References Cited

U.S. PATENT DOCUMENTS

| | | | |
|---|---|---|---|
| 4,474,847 | 10/1984 | Schröder et al. | 428/323 |
| 4,564,560 | 1/1986 | Tani et al. | 428/411.1 |
| 5,073,448 | 12/1991 | Vieira et al. | 428/331 |
| 5,132,146 | 7/1992 | Maruyama et al. | 427/261 |
| 5,223,338 | 6/1993 | Malhotra | 428/195 |

FOREIGN PATENT DOCUMENTS

| | | |
|---|---|---|
| 0487350 | 11/1991 | European Pat. Off. . |

*Primary Examiner*—Pamela R. Schwartz
*Attorney, Agent, or Firm*—Lockwood, Alex, Fitzgibbon & Cummings

[57] ABSTRACT

Ink jet printing materials comprise a support and an ink receiving layer containing a pigment, a hydrophilic binder comprising polyvinyl alcohol, vinylpyrrolidone homopolymer and/or vinylpyrrolidone copolymer, and a water soluble compound containing aldehyde groups.

25 Claims, No Drawings

INK JET PRINTING MATERIAL

This is a continuation of application Ser. No. 08/261,155, filed Jun. 17, 1994 now abandoned.

BACKGROUND, SUMMARY AND DESCRIPTION OF THE INVENTION

This invention relates to a printing material for the ink jet printing process and a coating compound for preparing an ink receiving layer for the material.

In ink jet printing systems printing operations are carried out by forming droplets of ink by means of various ink jet methods, such as electrostatic attraction methods, bubble formation processes, etc., and these droplets of ink are applied to a printing material. Such printing processes make it possible to print images with a very high resolution directly from electronic data. The image receiving materials used for this purpose must meet certain high requirements so that the image produced by the ink jet process will:

have a high resolution;

have a high color density;

have sufficient color gradations;

be smudgeproof; and be waterfast.

In order to satisfy these requirements or goals, the following basic conditions must be met:

the ink must be rapidly absorbed by the printing material;

the droplets of ink sprayed on the printing material must spread out in the most accurate possible manner in the shape of a circle and with precisely defined outlines;

the ink diffusion in the printing material must not be too great so that the diameter of the ink spots does not increase any more than is absolutely necessary;

when one ink spot overlaps with another ink spot which was previously applied, it should not have any negative effect or smear;

the printing material must have a surface that permits a high visual reflection density and a high brilliance of the dyes; and the printing material should have a high dimensional stability and should not stretch after the printing process.

Some of these requirements are contradictory to each other. For example, if the material becomes smudgeproof too rapidly, there will be little or no spreading of the droplet of ink and, thus, the clarity of the resulting image is impaired. On the basis of the requirements of the printing material, there has been a search for ways to obtain an image with the highest possible ink density, while still being as smudgeproof as possible.

Papers in which the ink fluids can be absorbed in the spaces formed between the pulp fibers in the paper or between the fibers and filler have been used as the printing material for ink jet printing. Another group of printing materials include papers having a special ink receiving layer.

The ink receiving layers consist essentially of a pigment/binder mixture. In addition to increasing the whiteness of the printing material, the pigments serve the function of retention of the dyestuffs from the printing ink on the surface of the sheet. A high pigment concentration leads to a high porosity of the layer (German Patent No. 30 24 205). This makes the paper quite smudgeproof. However, at the same time the dyes are also drawn out of the ink into the interior of the printing material, and this has a negative effect on the color density of the image.

Japanese Patent JP 61-041585 discloses a method of producing printing material with a receiving layer of polyvinyl alcohol and polyvinylpyrrolidone. The mixing ratio of the two components PVA to PVP is 3:1 to 1:5. However, a disadvantage of this material is its inadequate waterfastness and its wet rub off properties.

Japanese Patent JP 61-261089 discloses a transparent material for overhead projectors which contains a cationic conductive resin in addition to a mixture of polyvinyl alcohol and polyvinylpyrrolidone. This makes the paper smudgeproof and waterproof, but the wet rub off properties are not adequate.

Therefore, the object of the present invention is to provide a printing material for the ink jet printing process which will fulfill the requirements mentioned above, but specifically will assure a good waterfastness and wet rub off properties, in addition to a high color density and image definition or clarity.

This object is achieved by means of a printing material comprising a support and an ink receiving layer applied to the support and containing a polyvinyl alcohol, polyvinylpyrrolidone homopolymer and/or vinylpyrrolidone copolymer, and a water soluble substance containing aldehyde groups.

The water soluble substance containing aldehyde groups may be a melamine formaldehyde condensation product containing free CHO groups in the amount of at least 0.05 mol%. However, a polyvalent aldehyde, such as an oxalaldehyde, may also be used.

The quantity ratio of the water soluble substance to the hydrophilic binder present in the ink receiving layer which is a mixture of polyvinyl alcohol, polyvinylpyrrolidone homopolymer and/or polyvinylpyrrolidone copolymer, is 1:1 to 1:40. In a preferred embodiment, the ratio is 1:1.5 to 1:27.

The quantity ratio of polyvinyl alcohol to polyvinylpyrrolidone homopolymer and/or copolymer in the binder mixture is 10:1 to 4:1.

In a special embodiment of the invention, the polyvinylpyrrolidone copolymer is a vinylpyrrolidone vinyl acetate or a vinylpyrrolidone styrene copolymer.

The amount of water soluble substance containing aldehyde groups in the ink receiving layer is 2 to 15 wt %, especially 3 to 10 wt %.

The amount of binder in the layer is 15 to 80 wt %, especially 30 to 60 wt %.

In a special embodiment of the invention, the ink receiving layer contains a quaternary ammonium compound with a certain cationicity which is determined with PCD titration with a $1\times10^{-3}$ n solution of sodium polyethylenesulfonate (PES solution). The values for the cationicity obtained by this method for the ammonium compounds according to this invention amount to 15 to 30 ml PES solution, especially 20 to 25 ml PES solution. The quaternary ammonium compounds include, for example, polyamine salts and polyamideamine compounds. Polydiallyldimethylammonium chloride has proven to be especially advantageous.

The ink receiving layer according to the invention may also contain other additives, such as white pigments, colored pigments, dyes, dispersants, wetting agents, curing agents and optical brighteners.

Pigments that can be used in the ink receiving layer include silicic acid, clay, zeolites and other inorganic pigments. In a preferred embodiment of this invention, an amorphous silicic acid having a pore volume of 1.0 to 2.5 ml/g with a particle size of ≦5 μm is contained in the ink receiving layer. The amount of pigment in the ink receiving layer is 10 to 80 wt %, especially 40 to 65 wt %.

The ink receiving layer is applied to the carrier from an aqueous dispersion with the help of any of the conventional methods of application and metered addition. The coating weight of the ink receiving layer is 0.5 to 15 g/m$^2$, preferably 2 to 8 g/m$^2$. A plastic film or a coated or uncoated base paper may be used as the support. The base paper may be paper sized with an acidic or neutral size. A base paper sized with diketene and containing 5 to 20 wt % pigment and/or filler, such as $TiO_2$, $CaCO_3$ and $SIO_2$, is preferred.

In another preferred embodiment of the invention, the back side of the base paper has a layer containing a hydrophilic colloidal binder such as starch, modified starch, polyvinyl alcohol or gelatin. An oxidized potato starch is especially preferred.

The layer on the back side may contain up to 60 wt % fillers, such as for example, clay, zeolite, $CaCO_3$, and pigments and other additives.

The invention will be illustrated in greater detail in the following examples.

EXAMPLE 1

The front side of raw paper with a basis weight of 80 g/m$^2$ containing 20 wt % $CaCO_3$ in the pulp, and sized with a neutral alkylketene dimer size was coated with an aqueous coating compound and then dried. The resulting ink receiving layers had the following composition:

| Components | Composition, wt % | | | | | | | |
|---|---|---|---|---|---|---|---|---|
| | 1a | 1b | 1c | 1d | 1e | 1f | 1g | 1h |
| Polyvinyl alcohol | | | | | | | | |
| Degree of saponification: 98 mol % | 28.0 | — | — | — | — | — | — | — |
| Degree of saponification: 88 mol % | — | 28.0 | 28.0 | 28.0 | 28.0 | 28.0 | 28.0 | 28.0 |
| Polyvinylpyrrolidone Molecular weight: 630000 daltons | 7.0 | 7.0 | — | — | 7.0 | 7.0 | 7.0 | 7.0 |
| Vinylpyrrolidone vinyl acetate copolymer 70/30 | — | — | 7.0 | — | — | — | — | — |
| Vinylpyrrolidone styrene copolymer 50:50 | — | — | — | 7.0 | — | — | — | — |
| Amorphous silicic acid | | | | | | | | |
| A | 56.6 | 56.6 | 56.6 | 56.6 | — | 56.6 | 56.6 | 56.6 |
| B | — | — | — | — | 56.5 | — | — | — |
| Polyammonium salt with a cationicity of | | | | | | | | |
| 21.58 ml PES solution* | 3.5 | 3.5 | 3.5 | 3.5 | 3.5 | — | 3.5 | 3.5 |
| 24.37 ml PES solution* | — | — | — | — | — | 3.5 | — | — |
| Melamine formaldehyde condensation product | 5.0 | 5.0 | 5.0 | 5.0 | 5.0 | 5.0 | — | 5.0 |
| Oxalaldehyde | — | — | — | — | — | — | 5.0 | — |
| Amount applied, g/m$^2$ | 4 | 4 | 4 | 4 | 4 | 4 | 4 | 6 |

Where:
A is Particle size: 3.2 μm, pore volume 1.2 ml/g
B is Particle size: 3.0 μm, pore volume 1.8 ml/g
* is PES solution: $1 \times 10^{-3}$ n sodium polyethenesulfonate A layer was applied to the back side of the base paper consisting of oxidized potato starch and 20 wt % $CaCO_3$. The amount of substance applied to this backing side was 4 g/m$^2$.

| | |
|---|---|
| Machine speed: | 100 m/min |
| Drying temperature: | 130° C. |
| Drying time: | 5 minutes |

The resulting sheet material was printed in a thermal jet process and then analyzed. The test results are summarized in Table 1.

EXAMPLE 2

The front side of the base paper from Example 1 was coated with an aqueous coating compound and then dried. The resulting ink absorption layer had the following composition:

| Components | Composition, wt % | | | |
|---|---|---|---|---|
| | 2a | 2b | 2c | 2d |
| Polyvinyl alcohol Degree of saponification: 88 mol % | 28.0 | 28.0 | 28.0 | 28.0 |
| Polyvinylpyrrolidone Molecular weight: 630000 daltons | 7.0 | 7.0 | 7.0 | 4.0 |
| Amorphous silicic acid A | 50.0 | 50.0 | 58.0 | 52.0 |
| Polyammonium salt with a cationicity of 21.58 ml PES solution | 10.0 | 5.0 | 2.0 | 2.0 |
| Melamine formaldehyde condensation product | 5.0 | 10.0 | 5.0 | 2.0 |
| Amount applied, g/m$^2$ | 4 | 4 | 4 | 4 |

The back side of the base paper was provided with a starch coating as described in Example 1. The other experimental conditions were the same as in Example 1.

The test results of the resulting print images are summarized in Table 2.

Comparative Example V1

The procedure conformed to that of Example 1b, except that instead of polydimethyldiallylammonium chloride, an amide derivative having a cationicity of 13.11 ml PES solution was used.

Comparative Example V2

The base paper of Example 1 was provided with a receiving layer in which no water soluble substance containing aldehyde groups need be used.

The ink receiving layers according to the comparative Examples V1 and V2 were applied from a aqueous medium and had the following composition after drying:

| Components | Composition, wt % | |
|---|---|---|
| | V1 | V2 |
| Polyvinyl alcohol Degree of saponification: 88 mol % | 28.0 | 28.0 |
| Polyvinylpyrrolidone Molecular weight: 630000 daltons | 7.0 | 7.0 |
| Amorphous silicic acid A | 56.5 | 56.5 |
| Polyamideamine with a cationicity of 13.11 ml PES solution | 3.5 | — |
| Polydiallyldimethylammonium chloride (See Example 1) | — | 8.5 |
| Melamineformaldehyde resin | 5.0 | — |
| Amount applied, g/m$^2$ | 4 | 4 |

The printing material obtained in the comparative examples was printed in a thermal jet process and then analyzed. The results are summarized in Table 3.

In addition to the comparative examples, two commercial printing materials were also used and analyzed. The test results are also summarized in Table 3.

Testing the Printing Material Obtained According to the Examples and Comparative Examples The printing material was printed with a Hewlett Packard HP Deskjet 550 C that operates according to the bubble jet principle (thermal jet).

The color density, definition, waterfastness and wet rub off properties were tested on the resulting print images.

The density measurements were performed with an Original Reflection Densitometer SOS-45. The measurements were performed for the primary colors cyan, magenta, yellow and black.

For determining the waterfastness of the paper, the printing material was immersed in water. The density (%) remaining after 60 seconds in the water bath is used as a measure of the water stability.

The image clarity (definition) is determined with a fiber counter. Field distances between a red field and a green field or between two black fields are determined (maximum value 1 mm). The colored fields composed of the primary colors have 200% ink coverage. Therefore, they serve as test fields for fixing large quantities of ink.

To determine the wet rub off properties, a 1 kg weight covered with a wet towel is passed five times over a test strip printed with 100% of black or cyan ink, and the density loss is evaluated (grades of 1 to 5, wherein grade 1 is very good and grade 5 is poor).

TABLE 1

Properties of the Printed Printing Material Produced According to Example 1

| Example | Color density | | | | Definition (field distance in mm) | Water fastness (cyan) | Wet rub off properties (cyan) |
|---|---|---|---|---|---|---|---|
| | Cyan | Magenta | Yellow | Black | Red/green | % | Grade |
| 1a | 2.15 | 1.57 | 1.68 | 2.30 | 0.9 | 98.6 | 2 |
| 1b | 2.01 | 1.43 | 1.55 | 2.06 | 0.9 | 98.0 | 2 |
| 1c | 2.01 | 1.40 | 1.50 | 2.22 | 0.8 | 100.0 | 2 |
| 1d | 1.99 | 1.38 | 1.47 | 2.21 | 0.9 | 100.0 | 2 |
| 1e | 2.02 | 1.50 | 1.66 | 2.22 | 0.9 | 94.0 | 2 |
| 1f | 1.90 | 1.37 | 1.45 | 2.11 | 0.9 | 98.6 | 1 |
| 1g | 1.92 | 1.35 | 1.45 | 2.09 | 0.9 | 99.0 | 3 |
| 1h | 1.98 | 1.38 | 1.52 | 2.02 | 1.0 | 100.0 | 1 |

TABLE 2

Properties of the Printed Printing Material Produced According to Example 2

| Example | Color density | | | | Definition (field distance in mm) | Water fastness (cyan) | Wet rub off properties (cyan) |
|---|---|---|---|---|---|---|---|
| | Cyan | Magenta | Yellow | Black | Red/green | % | Grade |
| 2a | 2.01 | 1.48 | 1.58 | 2.20 | 0.9 | 100.0 | 2 |
| 2b | 1.94 | 1.40 | 1.52 | 2.11 | 0.8 | 97.0 | 1 |
| 2c | 1.99 | 1.38 | 1.48 | 2.14 | 0.9 | 91.0 | 2 |
| 2d | 2.10 | 1.54 | 1.65 | 2.14 | 0.8 | 90.0 | 3 |

TABLE 3

Tests of the Printing Material Prepared According to Comparative Examples V1 and V2, and the Usual Commercial Printing Material

| | Color density | | | | Definition (field distance in mm) | Water fastness (cyan) | Wet rub off properties (cyan) |
|---|---|---|---|---|---|---|---|
| Example | Cyan | Magenta | Yellow | Black | Red/green | % | Grade |
| V1 | 1.85 | 1.34 | 1.42 | 2.05 | 0.8 | 78.0 | 3 |
| V2 | 1.90 | 1.35 | 1.45 | 2.09 | 0.8 | 87.2 | 4 |
| Hp 51 630 Z CX Jet Ser. | 1.75 | 1.27 | 1.26 | 2.07 | 0.8 | 88.0 | 5 |
| Canon LC101 | 1.65 | 1.21 | 1.26 | 1.79 | 0.8 | 92.0 | 5 |

We claim:

1. Ink jet printing material comprising a support and an ink receiving layer, said ink receiving layer containing:

a pigment, a hydrophilic binder comprising a mixture of polyvinyl alcohol and a vinylpyrrolidone homopolymer and/or vinylpyrrolidone copolymer, and a water soluble compound containing aldehyde groups.

2. The material of claim 1, wherein said water soluble compound containing aldehyde groups is selected from the group consisting of a melamine formaldehyde condensation product and a polyvalent aldehyde.

3. The material of claim 2, wherein the ratio of the water soluble compound containing the aldehyde groups to the hydrophilic binder is about 1:1 to 1:40.

4. The material of claim 3, wherein said ratio is about 1:1.5 to 1:27.

5. The material of claim 1, wherein the ratio of the water soluble compound containing the aldehyde groups to the hydrophilic binder is about 1:1 to 1:40.

6. The material of claim 5, wherein said ratio is about 1:1.5 to 1:27.

7. The material of claim 1, wherein the amount of water soluble compound containing aldehyde groups in the ink receiving layer is between about 2 to 15 wt %.

8. The material of claim 7, wherein said amount is between about 3 to 10 wt %.

9. The material of claim 1, wherein the ink receiving layer also contains a quaternary ammonium compound.

10. The material of claim 9, wherein said quaternary ammonium compound has a cationicity of 15 to 30 ml of a $1\times10^{-3}$ n solution of sodium polyethenesulfonate.

11. The material of claim 9, wherein said quaternary ammonium compound is a polyamine salt.

12. The material of claim 11, wherein said quaternary ammonium compound is a polydiallyldimethylammonium chloride.

13. The material of claim 9, wherein the amount of quaternary ammonium compound does not exceed 10 wt %.

14. The material of claim 1, wherein said pigment is selected from the group consisting of amorphous silicic acid, a clay, a zeolite, an inorganic pigment and mixtures thereof.

15. The material of claim 14, wherein said amorphous silicic acid has a pore volume of about 1.0 to 2.5 ml/g at a particle size of $\leqq 5$ μm.

16. The material of claim 1, wherein the amount of pigment in the ink receiving layer is about 10 to 80 wt %.

17. The material of claim 16, wherein said amount of pigment is about 40 to 65 wt %.

18. The material of claim 1, wherein the amount of hydrophilic binder is about 15 to 80 wt %.

19. The material of claim 18, wherein said amount of hydrophilic binder is about30 to 60 wt %.

20. The material of claim 1, wherein said support is a sized raw paper, and the ink receiving layer is applied to said support in the amount of about 0.5 to 15 $g/m^2$.

21. The material of claim 20, wherein said amount of ink receiving layer is about 2 to 8 $g/m^2$.

22. The material of claim 1, wherein the side of the support opposite the ink receiving layer includes a starch sizing in the amount of about 2 to 7 $g/m^2$.

23. The material of claim 22, wherein said amount of starch sizing is about 3 to 5 $g/m^2$.

24. The material of claim 22, wherein said starch is an oxidized potato starch.

25. Ink jet printing material comprising a support and an ink receiving layer, said ink receiving layer consisting essentially of:

a pigment, a hydrophilic binder comprising a mixture of polyvinyl alcohol and a vinylpyrrolidone homopolymer and/or vinylpyrrolidone copolymer, a water soluble compound containing aldehyde groups, and a quaternary ammonium compound.

* * * * *

UNITED STATES PATENT AND TRADEMARK OFFICE

CERTIFICATE OF CORRECTION

PATENT NO. : 5,569,529

DATED : October 29, 1996

INVENTOR(S) : Dieter Becker, Gerhard Dransmann and Jurgen Graumann

It is certified that error appears in the above-indentified patent and that said Letters Patent is hereby corrected as shown below:

On the Cover page, the name of the Assignee should be --Felix Schoeller jr. Foto-und Spezialpapiere GmbH & Co. KG--.

Col. 4, before the first line and the table, insert --Other experimental conditions:--.

Signed and Sealed this

Seventh Day of October, 1997

*Attest:*

*Attesting Officer*

Bruce Lehman

BRUCE LEHMAN

*Commissioner of Patents and Trademarks*